United States Patent [19]

Stone

[11] Patent Number: 4,480,801

[45] Date of Patent: Nov. 6, 1984

[54] WEBBING SYSTEM

[75] Inventor: Rex D. Stone, York, Pa.

[73] Assignee: Motter Printing Press Co., York, Pa.

[21] Appl. No.: 377,607

[22] Filed: May 13, 1982

[51] Int. Cl.[3] ..... B65H 19/28; B41F 13/02

[52] U.S. Cl. ..... 242/56 R; 101/228; 226/92

[58] Field of Search ..... 242/56 R, 56.2, 56.4, 242/56.5, 56.6, 195, 147 R; 226/92; 101/225, 226, 227, 228; 271/212, 216, 219

[56] References Cited

U.S. PATENT DOCUMENTS

| | | | |
|---|---|---|---|
| 2,361,041 | 10/1944 | Lasch | 242/147 R |
| 2,944,345 | 7/1960 | Faeber | 226/92 X |
| 3,125,335 | 3/1964 | Becker | 101/227 X |
| 3,587,461 | 6/1971 | Polglase | 226/92 X |
| 4,070,965 | 1/1978 | Aenishaenslin et al. | 226/92 X |
| 4,079,877 | 3/1978 | McAnespie et al. | 226/92 |
| 4,111,122 | 9/1978 | Kutzner et al. | 226/92 X |

OTHER PUBLICATIONS

"Automatischer Bahneinzug-Seilsystem Albert-Tiefdruckrotationen", by Albert-Frankenthal, 1977, (4 pages).

GRI Report No. M-179, by Guenter Gebhard, Albert--Frankenthal AG, Nov. 11, 1981 (cover page and p. 6).

"Specifications for Webbing Equipment for 4 & 4 Color Rotogravure Press for McCall Printing Company", by Motter Printing Press Co., 1977, (cover page and pp. 1 & 2).

*Primary Examiner*—John M. Jillions
*Assistant Examiner*—Joseph J. Hail, III
*Attorney, Agent, or Firm*—Brumbaugh, Graves, Donohue & Raymond

[57] ABSTRACT

Apparatus for threading a web through a printing press includes a single cable extending through the press along the web path on one side of the web. The leading edge of the web is connected to the cable by a leader, so that the web is pulled through the printing press when the cable is driven. The cable is supported by sheaves that are mounted coaxially with the lead rollers that guide the web through the press.

9 Claims, 15 Drawing Figures

WEBBING SYSTEM

BACKGROUND OF THE INVENTION

This invention relates to printing presses and more particularly to apparatus for threading a web through a printing press.

A rotogravure printing press, for example, may include ten units, each of which has an impression roller and a design cylinder for applying ink to the web and numerous other rollers for conducting the web through a dryer, compensator and other press sections. Accordingly, it is time consuming to thread or pull a web from the unwind roll to the folder slitters, and prior art webbing systems often result in web wrinkles and breaks.

Conventional webbing systems use chains, or a pair of spaced cables or chains with a bar or elastic band suspended therebetween across the press, if the press is not webbed by hand. Some systems have independent drives, some require the press to be driven during webbing, and some require both.

The link and sprocket arrangement of a chain drive results in a chain path that can only approximate the web path, creating slack and/or tight webs that cause wrinkling of the web and web breaks during webbing. Other difficulties with a chain drive are that unacceptably high chain tensions result and that the chain usually does not stay on the sprockets.

Webbing systems using a bar across the press require press elements such as register eyes, drop rollers, etc. to be moved out of position to permit passage of the bar. Some systems require the press to be operating in order to pull the web through the press, creating the problem of matching the speeds of the webbing system and the press.

These and other disadvantages of the prior art webbing systems are overcome by the present invention.

SUMMARY OF THE INVENTION

In accordance with the invention, a webbing system is provided in which a single cable extends through the press along the web path on one side of the web. The leading edge of the web is connected to the cable by a leader, and the cable is independently driven to pull the web through the press. The webbing operation is therefore not limited by the speed of the press, and the speed of the webbing system need not be matched to that of the press, which is stationary during webbing.

The cable is supported by sheaves that are mounted coaxially with the lead rollers that guide the web through the press, so that the cable closely follows the web path throughout the press. No additional clearances have to be provided between the webbing system and any press elements during webbing.

BRIEF DESCRIPTION OF THE DRAWINGS

These and additional advantages of the invention will be more readily apparent from the following description of preferred embodiments, taken in conjunction with the accompanying drawings, wherein.

DESCRIPTION OF THE PREFERRED EMBODIMENTS

Figure 1:
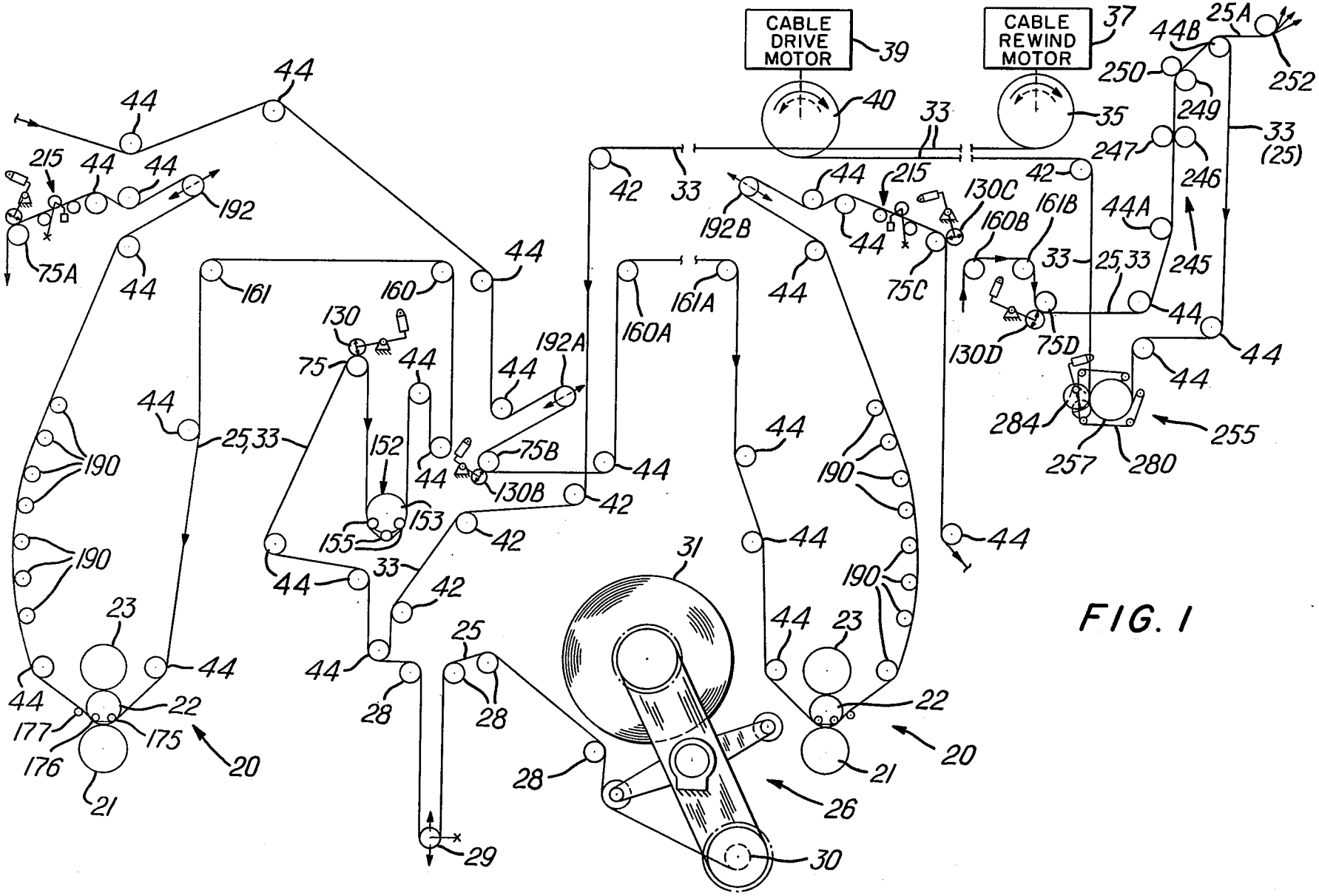
FIG. 1 is a schematic diagram of a printing press having the webbing system according to the invention.

The preferred embodiments of the present invention will now be described with reference to FIGS. 1–15 of the drawings. Like elements which are shown in the various figures are designated by the same reference numerals.

Wherever possible, the apparatus shown in these figures has been simplified so as not to obscure the novel features characteristic of the invention with details of conventional parts and elements well known to those skilled in the art. For further clarity of understanding, the webbing system is described below for threading a continuous web of paper through a printing press. It will be understood, however, that this system may be used for threading other types of flexible webs through other types of processing machines.

As illustrated in FIG. 1, the webbing system according to the present invention is employed in a printing press comprising a plurality of press units 20, each including the conventional design cylinder 21, impression roller 22 and impression back-up roller 23, although back-up rollers are not used in some printing presses, as is well known in the art.

The web 25 is supplied to the press units 20 from a conventional automatic splicing rollstand 26 and a plurality of guide rollers 28 and a conventional floating roller 29, which is mounted for movement back and forth in the direction of the arrows to control the tension in the web 25. As is well known, the rollstand 26 is used for transferring a running web from one rotating web supply roll 30 to another roll 31 when the roll 30 is about to expire.

The web 25 is threaded through the printing press by a single cable 33 which is supported inside of and adjacent to one of the two press side frames, following the web path through the press, as will be explained hereinafter.

The cable 33 is preferably a conventional aircraft cable one end of which is secured to and wound around an unwind drum 35, which is preferably mounted on the press side frames so as to be located above the press units 20. The unwind drum 35 is controlled by a cable rewind motor 37, which is preferably a conventional electric motor with a conventional eddy current clutch which developes a relatively low torque to maintain a desired cable tension while the web 25 is being webbed and while the press is running (after webbing is completed). The motor 37 develops a relatively high torque to rewind the cable 33 on the unwind drum 35 after webbing is completed.

The cable 33 is driven forward to thread the web 25 through the press by a motor 39 that drives a cable drive drum 40, the other end of the cable being secured to and wound around the drum 40. The motor 39 is preferably a conventional reversible variable speed motor. When the cable 33 is being rewound on the drum 35, the cable is rewound by the rewind motor 37, but the speed of rewind is determined by the speed of the (reversed) drive motor 39.

The cable 33 is supported by a plurality of idler sheaves or pulleys 42 between the unwind drum 35 and the place where the cable approaches the web 25 in the vicinity of the rollstand 26, and also between the place where the cable leaves the web path downstream of the last press unit 20 and the drive drum 40.

The cable 33 moves into the vicinity of the web 25 at a web lead roller 44. The web is supported there by the roller 44, and the cable is supported by a sheave 45 (see FIGS. 3 and 4) that is mounted adjacent to and coaxially with the roller 44. In particular, the journal 46 at the end of the roller 44 adjacent the cable 33 is received in a conventional non-friction bearing 47, which in turn is mounted in a bracket 48 that is secured by a plurality of bolts 49 to the adjacent press side frame 50.

Also mounted on the bracket 48 is another conventional non-friction bearing 52, which supports the sheave 45 so that it is coaxial with the roller 44. The sheave is formed with a groove 54 which receives the cable 33, and the diameters of the groove and the cable are such that the pitch line of the cable is coplanar with the surface of the roller 44. That is, the centerline of the portion of the cable engaged by the sheave is coplanar with the roller surface.

The journal at the opposite end of the roller 44 is received in a conventional non-friction bearing (not shown) that is mounted on the opposite press side frame (not shown).

Preferably a conventional tensiometer (not shown) is included in the mounting for the roller 44, in order to measure the tension of the web 25 in accordance with well known procedures for printing presses which form no part of the present invention and need not be discussed herein. Such tensiometers are at several locations of the web path through the printing press, as is well known to the art.

Figure 2:
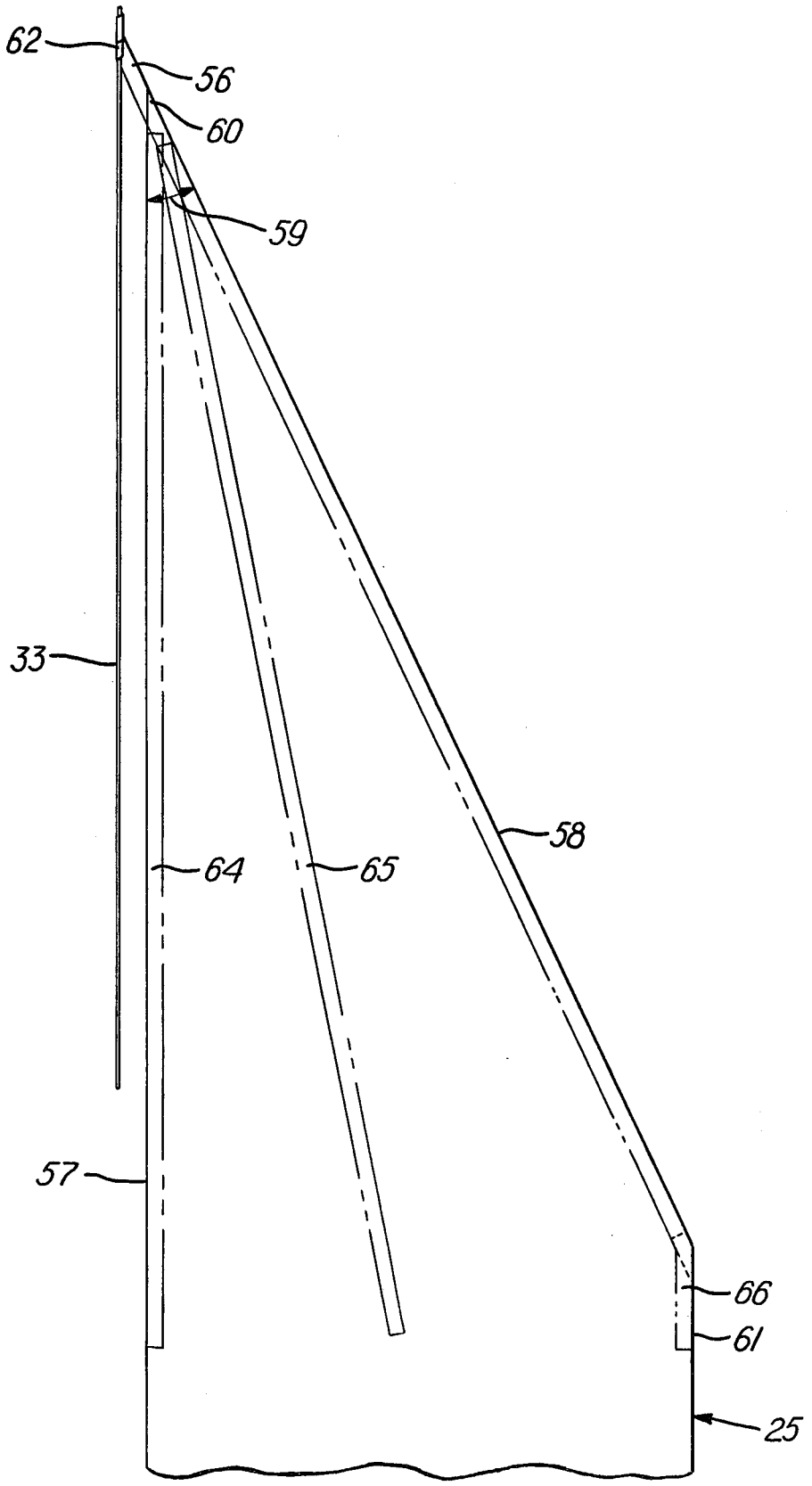
FIG. 2 is an illustration of a leader for connecting the web to the webbing cable according to a preferred embodiment of the invention.
Figure 3:
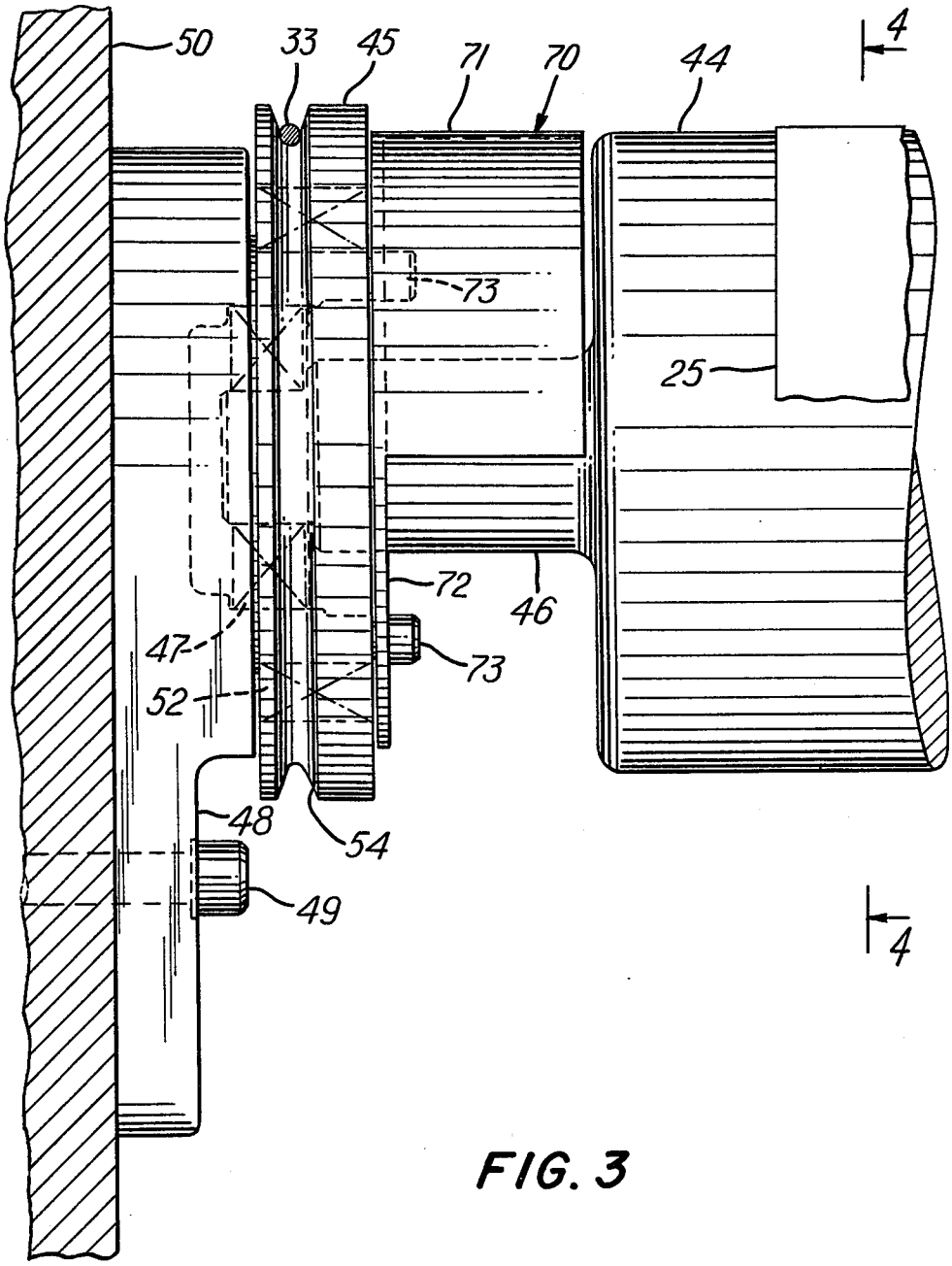
FIG. 3 is a side elevational view of a roller bearing and sheave assembly that may be utilized in the system of the invention.
Figure 4:
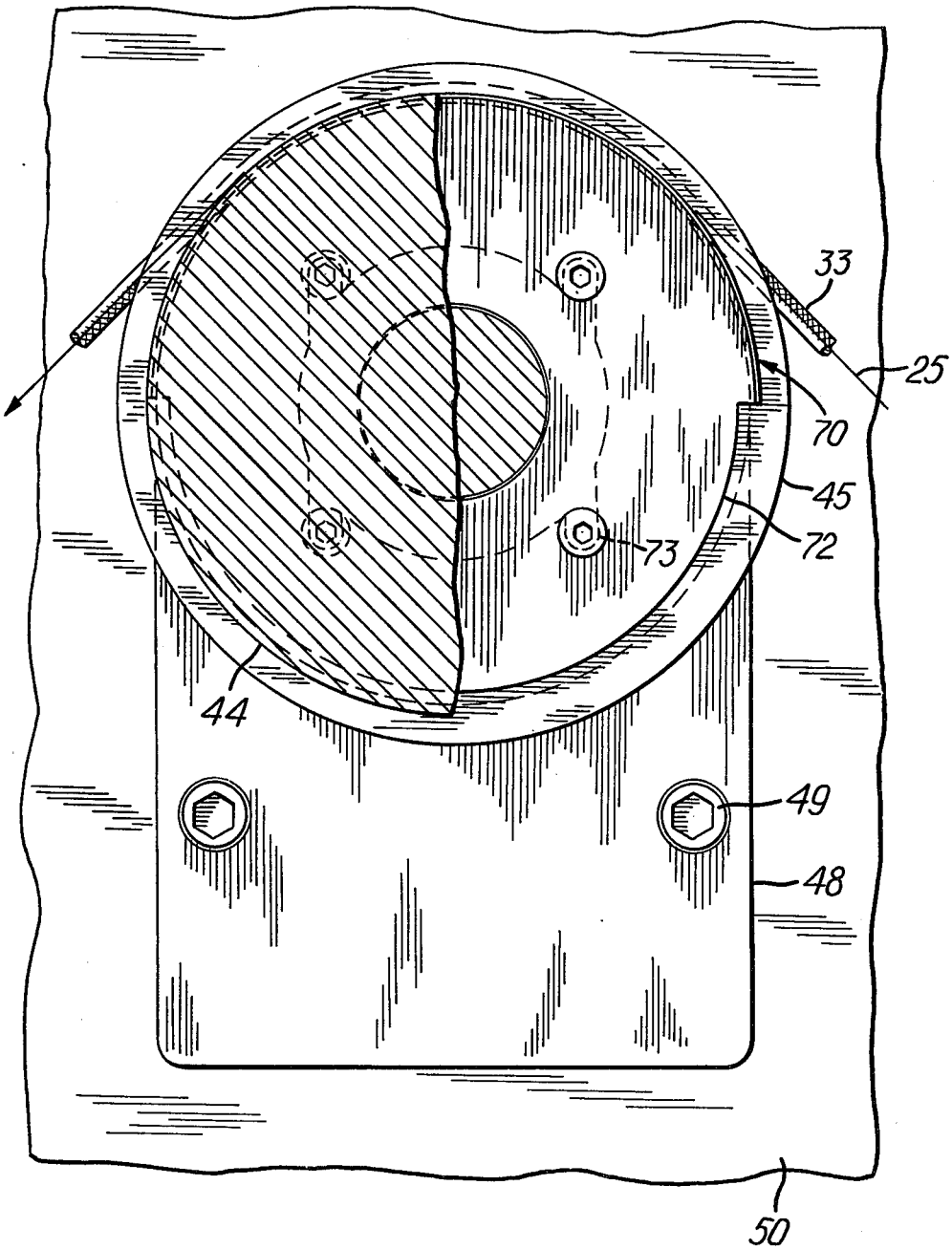
FIG. 4 is a view taken along the line 4—4 of FIG. 3 and looking in the direction of the arrows.

Referring to FIG. 2, the web 25 is connected to the cable 33 by a leader 56. The leading edge of the web is torn to provide an angle of preferably not greater than about 25° between the lateral web edge 57 adjacent the cable and the torn edge 58, such angle being indicated at 59. This insures that the entire web remains taut and results in a better guiding of the web. The leader 56 is preferably a plastic adhesive tape that is attached to the entire leading edge 58 from the leading corner 60 to the lateral web edge 61 remote from the cable, and the leader is attached to the cable at 62 by wrapping the leading end of the leader around the cable several times. Preferably the web 25 is reinforced by a plastic tape 64 extending from the leading corner 60 along and attached to the lateral web edge 57, a plastic tape 65 attached to the web and extending from the corner 60 intermediate the web edges 57 and 58, and a plastic tape 66 extending from the leading edge 58 along and attached to the lateral web edge 61.

Referring again to FIG. 3, there is mounted between the roller 44 and the sheave 45 a leader guide 70 comprising a semicircular element 71, the outer surface of which is coplanar with the surface of the roller, and a mounting plate 72, which is mounted on the bracket 48 by a plurality of bolts 73. The guide 70 is sufficiently spaced from the roller 44, sheave 45 and bearing 52 so as not to interfere with the rotation thereof.

The leader guide 70 provides a bridge between the roller 44 and the sheave 45 for the leader 56 and thus insures that the leader does not become entangled as it passes the roller and sheave.

The web 25 and the cable 33 go from the roller 44 to a cable driven roller 75 (see FIGS. 5 and 6), which supports the web. The cable is supported by a sheave 77, which is mounted adjacent to and coaxially with the roller 75. The roller journal 79 is received in a conventional non-friction bearing 80, which in turn is mounted in a bracket 82 that is secured by a plurality of bolts 83 to the adjacent press side frame 50.

The other roller journal is received in a conventional non-friction bearing (not shown) that is mounted on the opposite press side frame (not shown).

Also mounted on the bracket 82 is a conventional non-friction bearing 85, which supports the sheave 77 so that it is coaxial with the roller 75. The sheave is formed with a groove 87 which receives the cable 33, and the diameter of the groove is such that the pitch line of the cable is substantially coplanar with the surface of the roller 75.

The diameter of the pitch line of the cable in the groove 87 is actually preferably very slightly less than the diameter of the roller 75 so that the linear speed of the surface of this roller is approximately one percent greater than the speed of the cable (and thus the web). This results in some slippage between the roller 75 and the web 25 and produces a slight tension in the web.

Mounted between the roller 75 and the sheave 77 is a ring 90 comprising a mounting plate 91, which is mounted on the sheave by a plurality of bolts 92, and a cylindrical element 93, which extends over, in spaced relation to, a reduced diameter portion 95 of the roller. The outer surface of the ring element 93 is coplanar with the surface of the roller 75, so that the element 93 acts as a leader guide.

Mounted for reciprocation in opposite sides of the roller reduced diameter portion 95 are a pair of pistons 98 and 99, which reciprocate in a pair of bores 100 and 101 in a pair of plugs 102 and 103, which are threadedly secured in a pair of bores 104 and 105, respectively, in the roller portion 95. A pair of friction pads 106 and 107 are secured to the outer faces of the pistons 98 and 99, respectively. Alternatively, the friction pads may be omitted and a tooth provided on the interior of the ring element 93 to be engaged by one of the pistons when they are extended. A pair of springs 108 and 109, acting between shoulders 110 and 111 formed on the plugs 102, 103 and enlarged diameter portions 112 and 113 of the pistons 98 and 99, respectively, bias the pistons to the retracted positions illustrated.

The bores 104 and 105 communicate through a pair of radial bores 116 and 117 and an axial bore 118 to a conventional rotary seal 120 mounted on the bracket 82. The seal 120 communicates through a conduit 122 and a valve 124 with a source of air under pressure.

When the press is to be webbed, the valve 124 is opened so as to supply pressurized air through the conduit 122, seal 120 and bores 116, 117 and 118 to the pistons 98 and 99 to drive them outwardly against the biasing action of the springs 108 and 109 so that the friction pads 106 and 107 engage the ring 90, thereby locking the sheave 77 to the roller 75 by means of the clutch mechanism including the ring 90 and the pistons 98, 99 with their friction pads 106, 107.

When the cable 33 is driven forward to web the press, the cable drives the sheave 77, which in turn drives the roller 75 through this clutch mechanism. When the webbing operation has been completed and the cable 33 is to be rewound on the rewind or unwind drum 35, the valve 124 is closed and the pressurized air in the bores 116, 117 and 118 is vented, so that the springs 108, 109 retract the pistons 98, 99 away from the ring 90, thereby disengaging the clutch mechanism. The roller 75 is then free to turn with the web 25 when the press is running.

Figure 5:
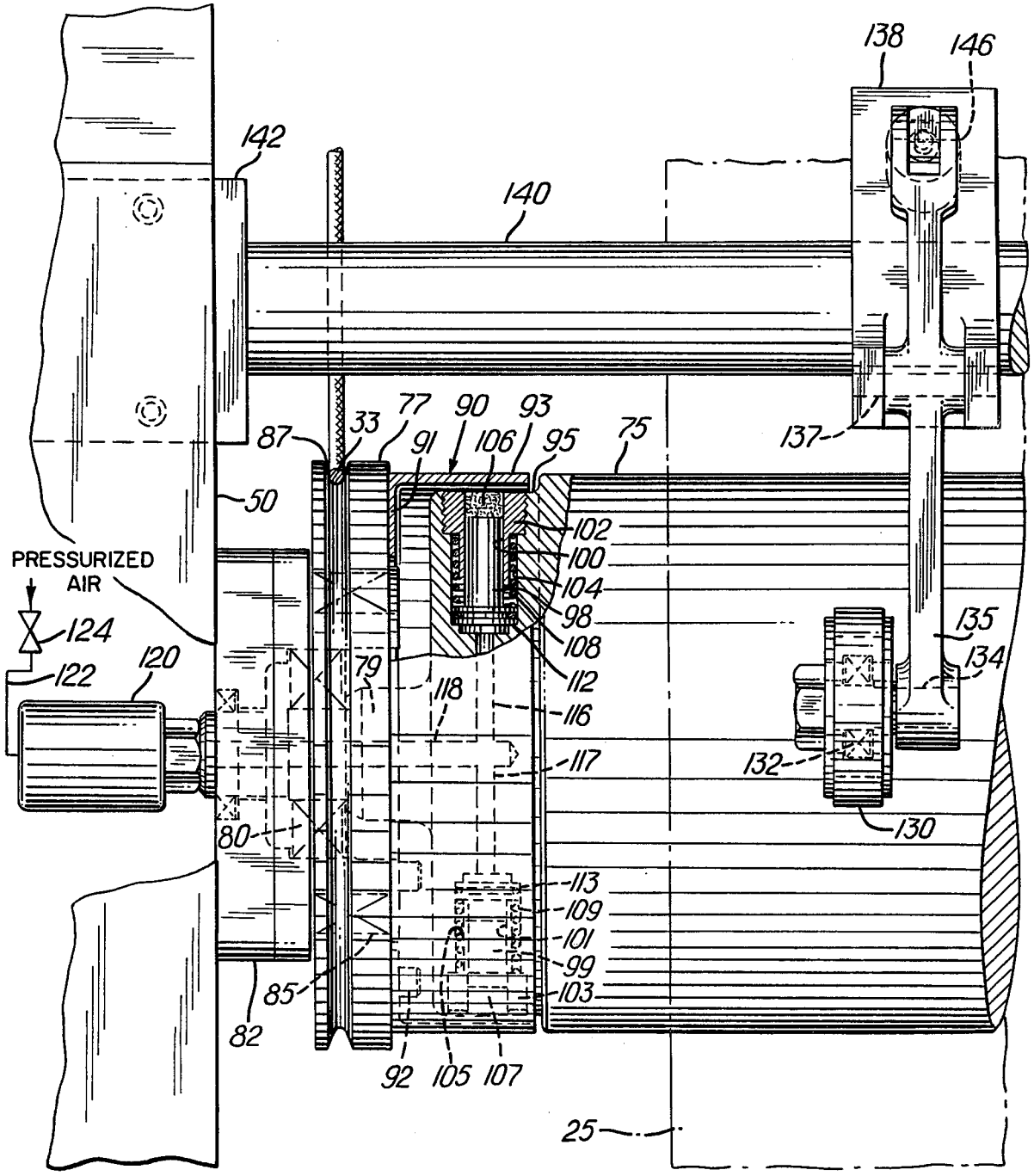
FIG. 5 is a side elevational view of a cable driven roller assembly that may be utilized in the system of the invention.
Figure 6:
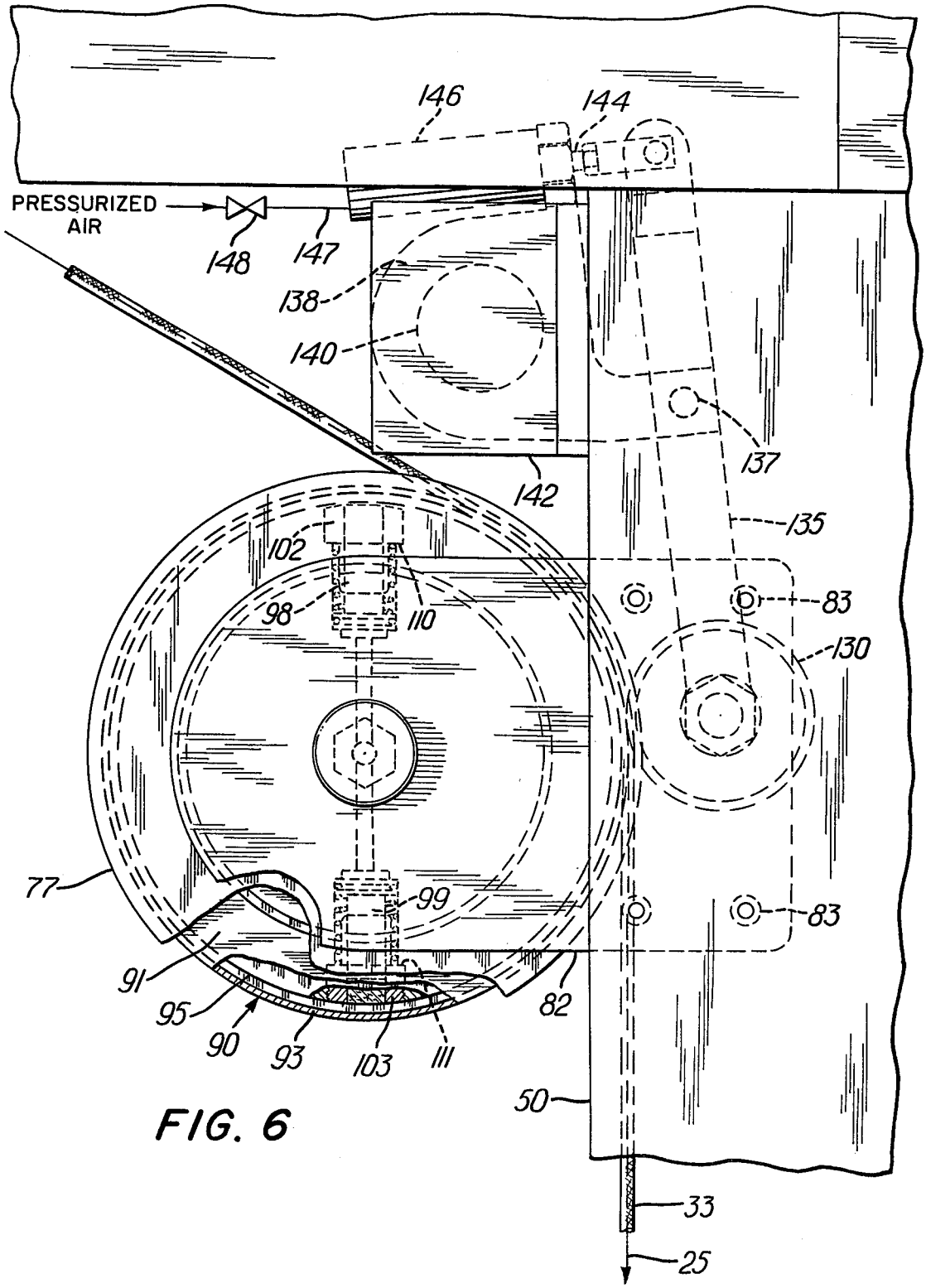
FIG. 6 is an end elevational view of the assembly illustrated in FIG. 5.

The roller 75 may also serve as the infeed when the press is running by connecting this roller to the press drive through a conventional clutch (not shown), the clutch being connected to the roller journal not shown in FIG. 5. During webbing the clutch is disengaged.

A plurality of trolley rollers 130 are mounted along the roller 75 to produce a nip for better web control. Each trolley roller is mounted by conventional non-friction bearings 132 to a pin 134 mounted at the free end of an arm 135, which can pivot intermediate its ends about a pin 137 carried by a mount 138 that is secured to a horizontal bar 140. The bar 140 is supported at each end by a bracket 142 that is secured to the adjacent press side frame.

The end of the arm 135 remote from the trolley roller 130 is pinned to a piston rod 144 connected to a piston (not shown) that reciprocates in a conventional pneumatic cylinder 146, which communicates through a line 147 and valve 148 to a source of pressurized air. The piston is spring biased to lift the trolley roller 130 away from the roller 75.

When the press is to be webbed, the valve 148 is opened to supply pressurized air to each cylinder 146 so as to urge all of the trolley rollers 130 against the roller 75, thereby providing good web control during the webbing of the press. When the webbing operation has been completed, the valve 148 is closed and the cylinders 146 are vented so that the springs (not shown) in these cylinders raise the trolley rollers 130 away from the roller 75.

From the cable driven roller 75 the web 25 and the cable 33 go to a conventional floating roller and counterbalance assembly 152, which promotes uniform tension in the web when the press is running, as is well known to the art. The assembly 152 includes a floating roller 153, which supports the web. Three sheaves 155, which support the cable 33, are mounted inside of the side frame 50 such that the lengths of the cable and the web are equal in the vicinity of the assembly 152 when the roller 153 is in the down position. Also mounted on the side frame is a leader guide (not shown) that includes a semicircular surface extending between the sheaves 155 and the roller 153 so that the leader 56 does not become entangled as it passes the assembly 152.

During webbing, the roller 153 stays in the down position by gravity in view of the relatively low web tension. When the press is running, there is a relatively high web tension and the roller 153 floats.

From the floating roller and counterbalance assembly 152 the web 25 and cable 33 go by way of a plurality of lead rollers 44 and their associated sheaves 45, respectively, to a pair of conventional web aligning rollers 160 and 161. As is well known to the art, the rollers 160 and 161 are mounted so that their ends may be adjusted so as to skew the rollers as necessary to align the web. In the press with the webbing system according to the present invention a sheave and leader guide (not shown) are mounted between each web aligning roller and the side frame 50 that are in all essential respects the same as the sheave 45 and leader guide 70. The sheaves and leader guides for the rollers 160 and 161, however, are mounted so as to move with the adjacent roller ends and remain coaxial with the respective rollers during adjustment thereof, so that the cable 33 follows the path of the web 25 around the rollers 160 and 161 at all times.

Figure 7:
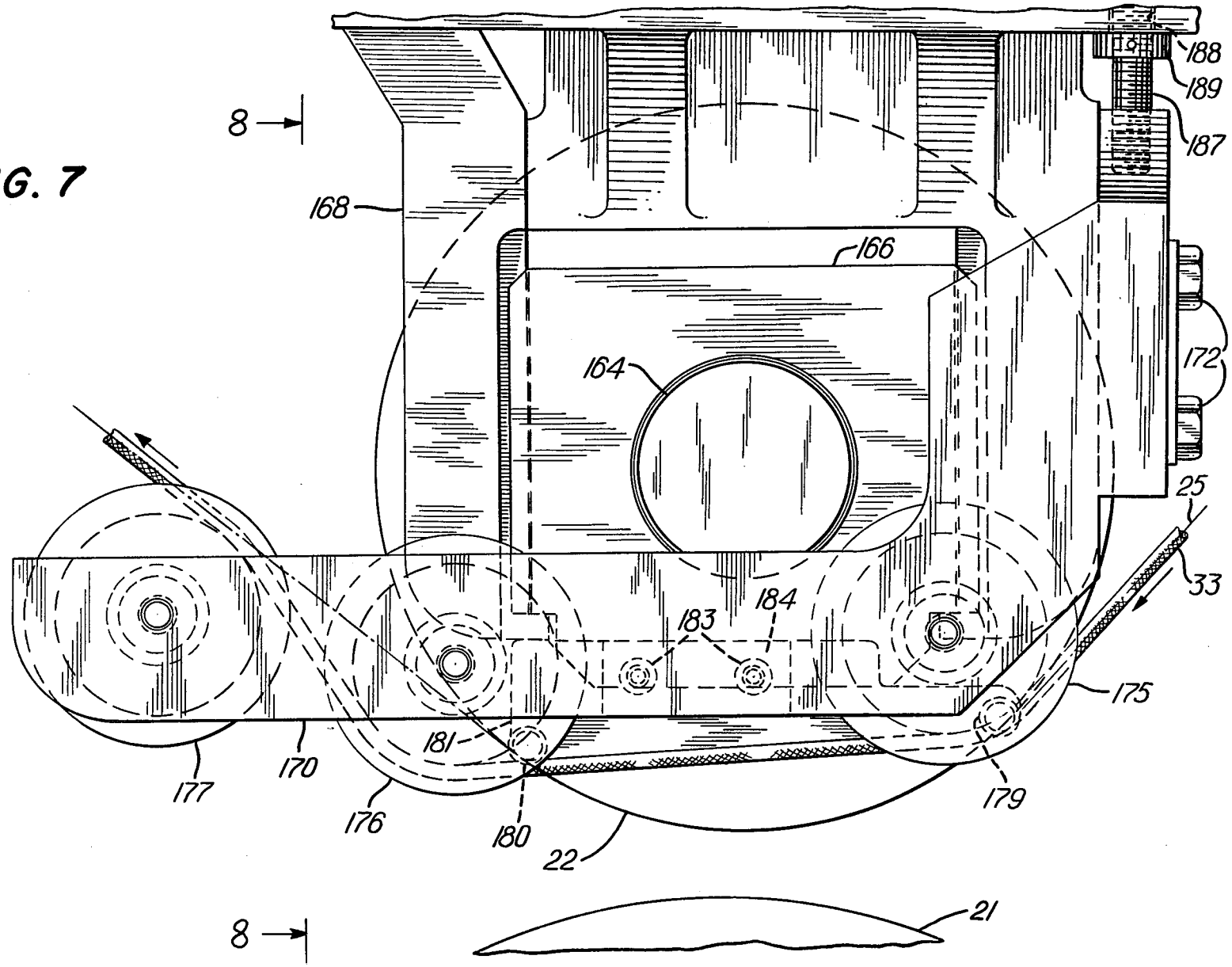
FIG. 7 is a side elevational view of the impression area of a press unit utilizing the system of the invention.
Figure 8:
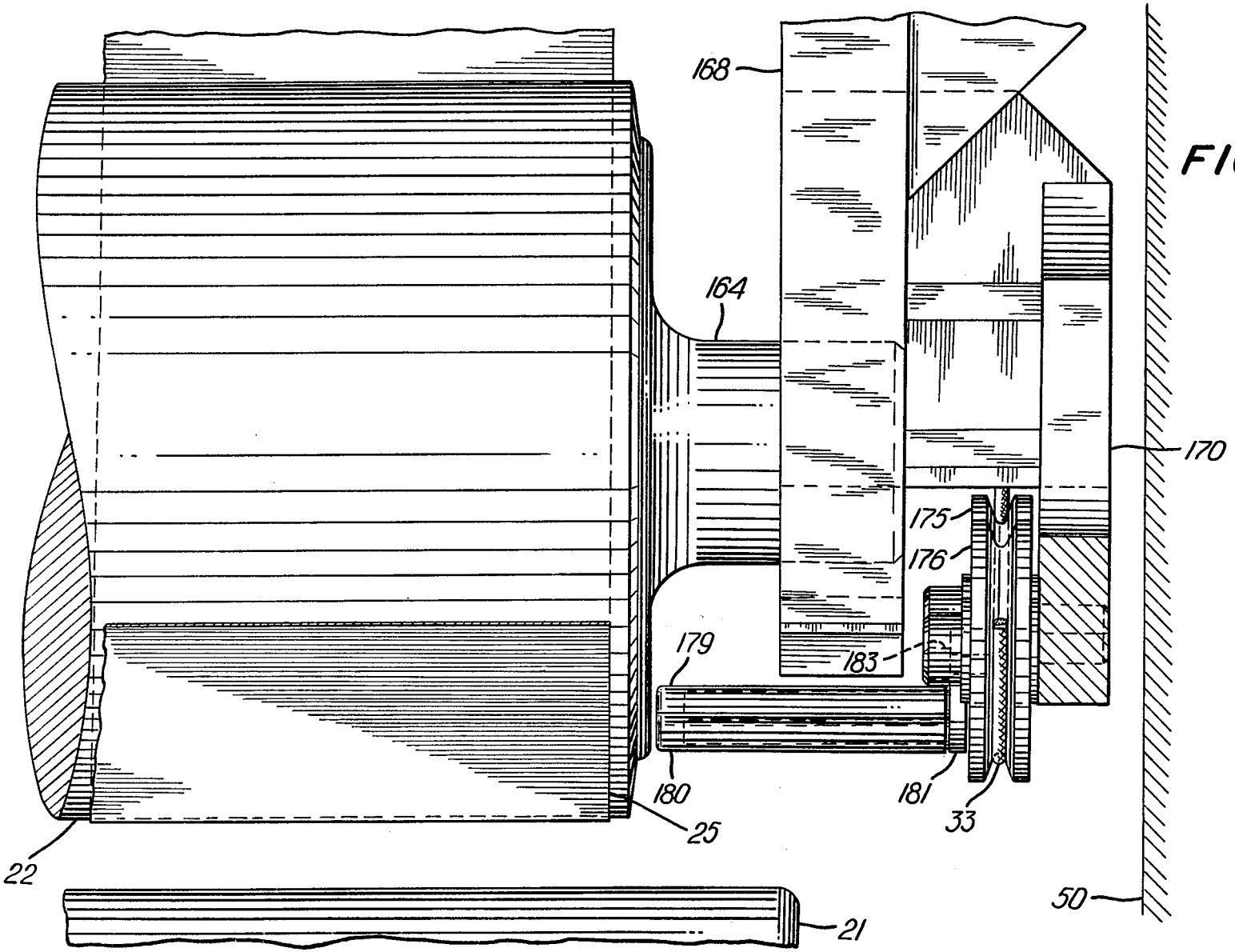
FIG. 8 is a view taken along the line 8—8 of FIG. 7 and looking in the direction of the arrows.
Figure 9:
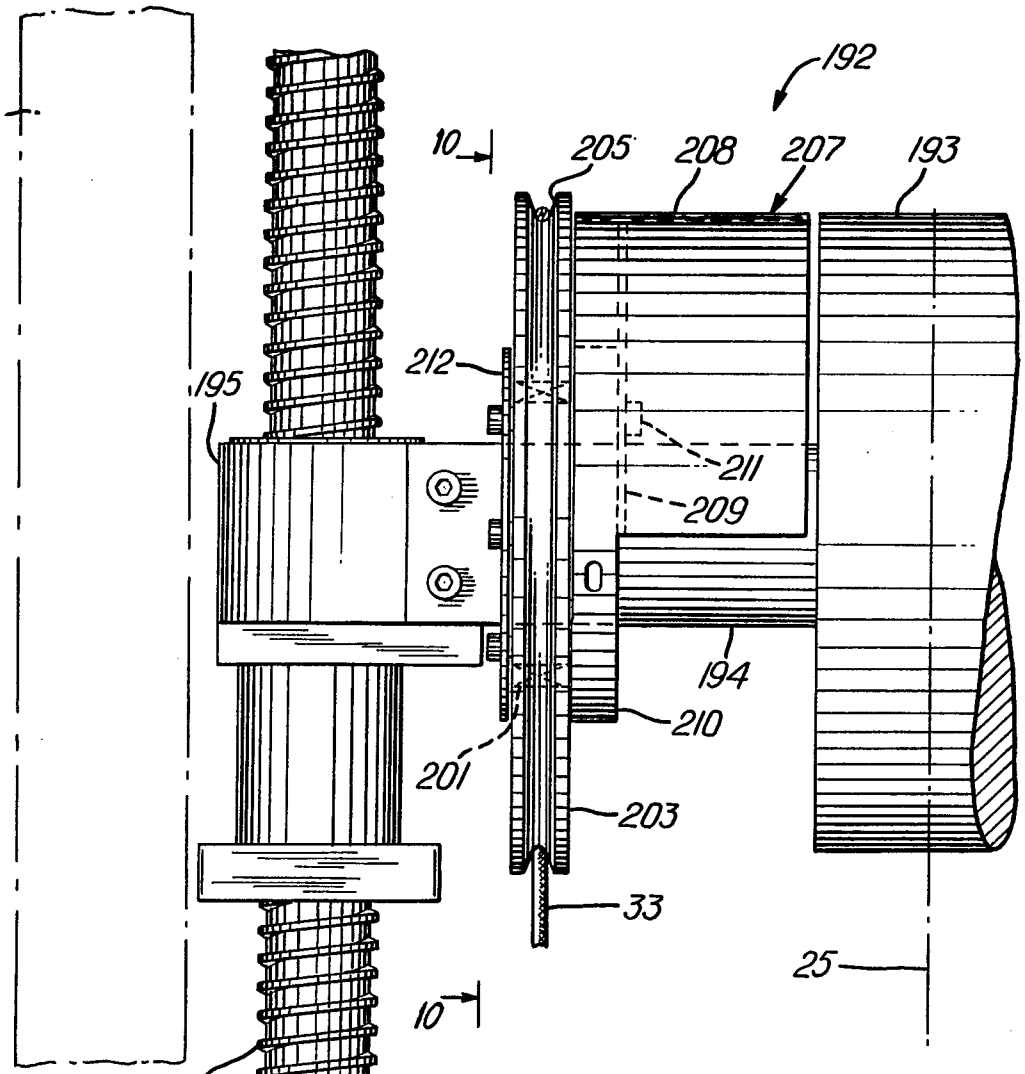
FIG. 9 is a side elevational view of a sheave and compensator assembly that may be utilized in the system of the invention.
Figure 10:
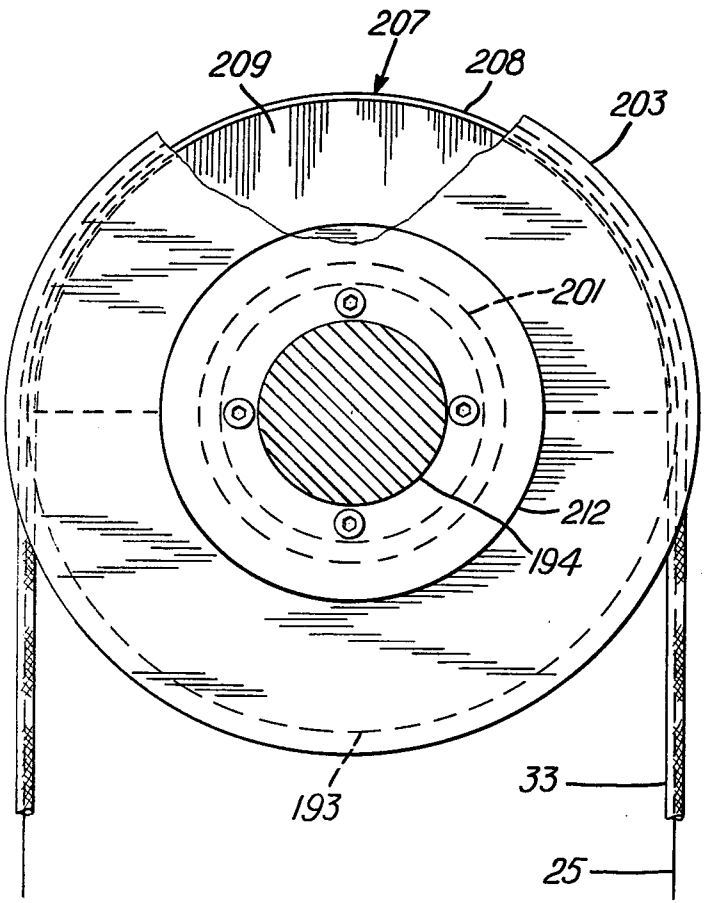
FIG. 10 is a view taken along the line 10—10 of FIG. 9 and looking in the direction of the arrows.

From the web aligning rollers the web 25 and cable 33 go by way of a plurality of lead rollers 44 and their associated sheaves to the impression area of the first unit 20 (see FIGS. 7 and 8).

The journal 164 at each end of the impression roller 22 is received in a conventional non-friction bearing (not shown) in a slide block 166, which may slide in an end frame 168, which also mounts the back-up roller 23 (not shown in FIGS. 7 and 8). Pressure is applied between the design cylinder 21 and the impression roller 22 by the combined weight of the impression roller and the back-up roller and also by a downward force applied to the journals of the back-up roller by a conventional loading mechanism (not shown), as is well known to the art.

An arm 170, which is secured to one end to the end frame 168 adjacent the cable 33 by a plurality of bolts 172, extends adjacent to and spaced from the end of the impression roller 22. Mounted for rotation on the arm 170 are three sheaves 175, 176 and 177, which are located on the arm so as to support the cable 33 in the impression area along a path which differs from the path of the web 25 while matching the length of the cable path with that of the web path. Thus the longer path length of the web during its contact with the impression roller 22 equals the longer path length of the cable in the vicinity of the sheaves 176 and 177 (see FIG. 7).

A pair of leader guides 179 and 180 are mounted on a plate 181, which is secured to the arm 170 by a pair of bolts 183, the plate being spaced from the arm by a spacer block 184 so as to provide clearance between the plate and the sheaves 175 and 176. The leader guides 179 and 180 are elongated cylindrical members mounted for rotation and having free ends in close proximity with the impression roller 22 to provide a bridge between the sheaves 175 and 176, respectively, and the impression roller, without interfering with the rotation of the impression roller.

The leader guides 179 and 180 insure that the leader 56 is smoothly guided onto the impression roller 22 and does not become entangled as it passes through the impression area.

A bolt 187 is received in a bore 188 in the end frame 168 and threadedly engages the arm 170 to permit fine vertical adjustment of the arm (and thus the sheaves 175, 176, 177 and the leader guides 179, 180) with respect to the impression roller 22. A collar 189 pinned to the bolt 187 prevents axial movement of the bolt with respect to the end frame when the bolt is rotated. Thus, when the surface of the impression roller is sufficiently worn down, the bolts 172 may be loosened and the bolt 187 rotated in the appropriate direction to raise the sheaves and the leader guides a corresponding amount. Then the bolts 172 are tightened to secure the arm 170 in the adjusted position. In this way the length of the cable path can always be matched with that of the web path in the impression area.

From the impression area the web 25 and cable 33 go by way of a plurality of lead rollers 44 and their sheaves and a plurality of lead rollers 190 in the dryer section to a conventional compensator 192. Associated with the lead rollers 190 are sheaves and leader guides arranged to operate the same as the rollers 44 and their sheaves and leader guides described in detail above.

The compensator 192 (see FIGS. 9 and 10) includes a roller 193 that is mounted at each end by a conventional non-friction bearing (not shown) to a shaft 194 which is secured to an interiorly threaded block 195 that receives a ball screw 197. Each ball screw is mounted on a mounting bracket 199 that is secured to the corresponding press side frame (not shown). As is well known to the art, the ball screws 197 may be simultaneously rotated in the appropriate direction to adjust the registry of the web with the printing cylinder 21.

In accordance with the present invention the block 195 mounts a conventional non-friction bearing 201, which supports a sheave 203 so that it is coaxial with the roller 193. Like the sheave 45, the sheave 203 is formed with a groove 205 which receives the cable 33 such that the pitch line of the cable is coplanar with the surface of the roller 193.

Mounted between the roller 193 and the sheave 203 is a leader guide 207 comprising a semicircular element 208, the outer surface of which is coplanar with the surface of the roller, and a mounting plate 209, which is mounted on a plate 210 by a plurality of bolts 211. The plate 210 and a plate 212 on the opposite side of the sheave 203 are secured to the block 195 and prevent axial displacement of the sheave and the bearing 201.

The leader guide 207 is sufficiently spaced from the roller 193 and the sheave 203 so as not to interfere with the rotation thereof, and provides a bridge therebetween for the leader 56 and thus insures that the leader does not become entangled as it passes the roller and sheave.

Inasmuch as the roller 193, sheave 203 and leader guide 207 are mounted from the block 195, they move together and remain coaxial when the ball screw 197 is rotated. Thus the cable 33 follows the path of the web 25 around the roller 193 at all times.

Figure 11:
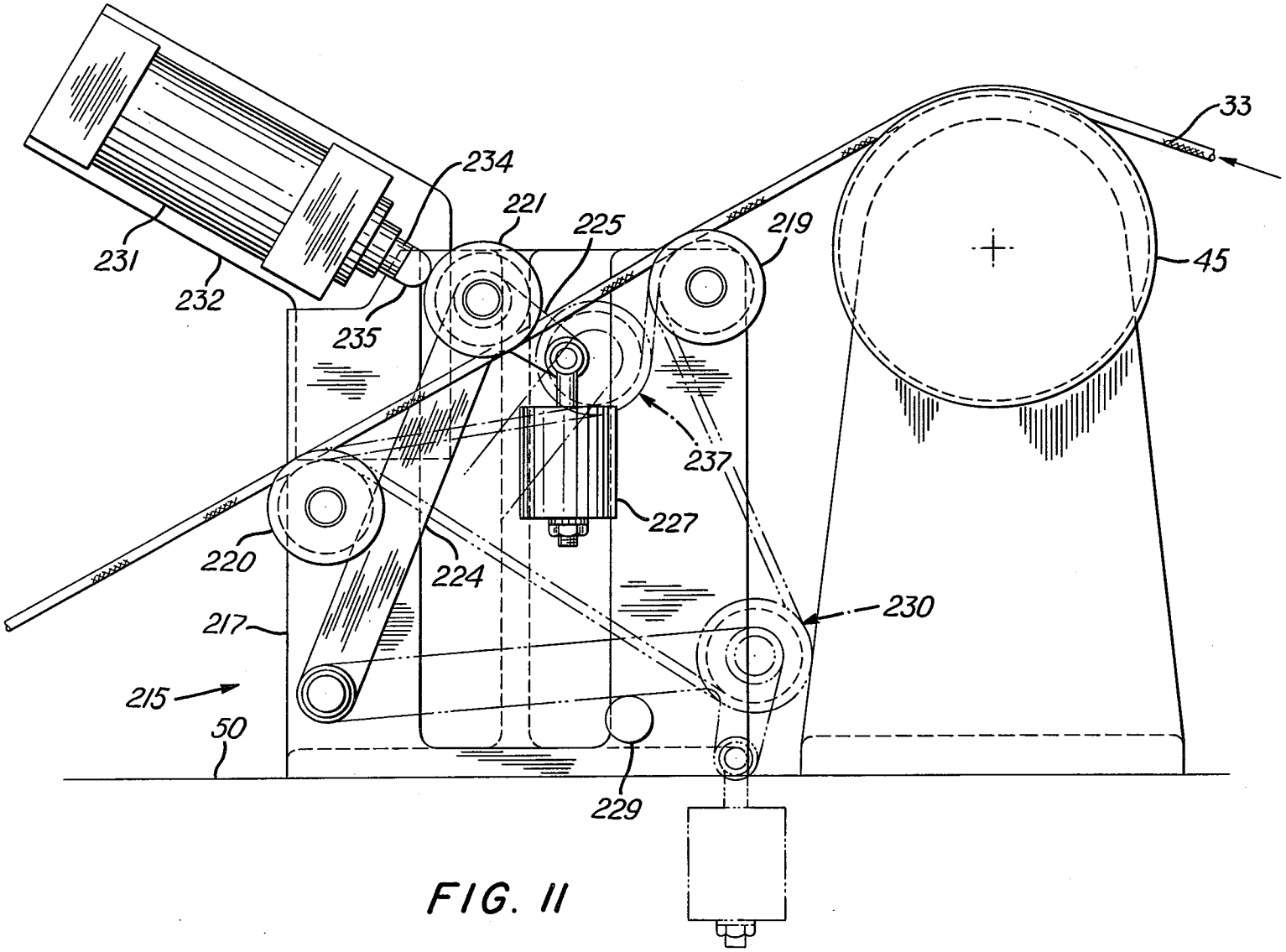
FIG. 11 is an elevational view of a cable take-up assembly that may be utilized in the system of the invention.
Figure 12:
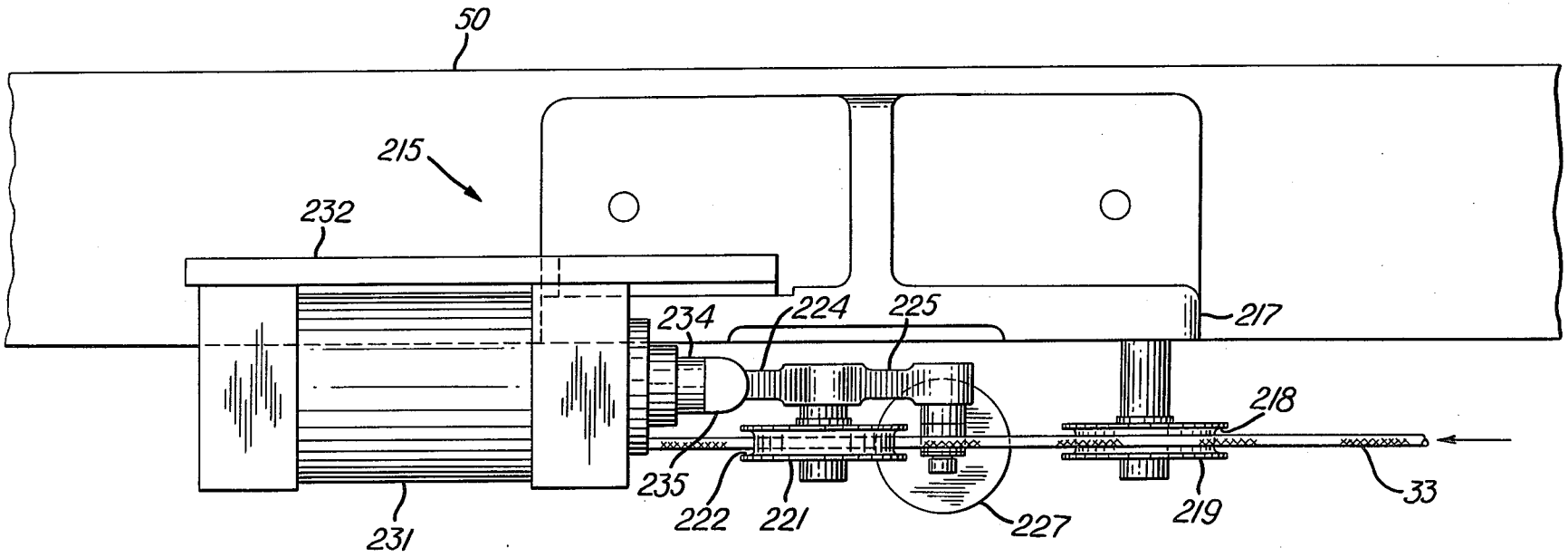
FIG. 12 is a plan view of the assembly illustrated in FIG. 11.

From the compensator 192 the web 25 and cable 33 go by way of a plurality of lead rollers 44 and their sheaves to a cable take-up assembly 215 (see FIGS. 11 and 12). The web merely passes by this assembly, without engaging any elements thereof.

The cable take-up assembly is mounted on a subframe 217, which in turn is mounted on the press side frame 50. The cable 33 is received in the grooves 218 of a pair of spaced sheaves 219 and 220 that are mounted for rotation on the subframe 217 below the cable. A floating sheave 221 receives the cable in its groove 222 and is pivotally mounted to the subframe above the cable. The sheave 221 is mounted for rotation at one end of an arm 224, the opposite end of which is pivotally mounted to the subframe.

The arm 224 includes a lateral extension 225 at its free end, and a weight 227 is pivotally connected to the free end of the extension 225. The weight may weigh approximately five pounds, for example, in the illustrated embodiment. Accordingly, the weight biases the arm 224 in the clockwise direction (as viewed in FIG. 11) and thus urges the floating or take-up sheave 221 against the cable, taking any slack out of the cable and insuring that the cable stays on the various sheaves.

A stop 229 mounted on the subframe determines the lowest position of the take-up sheave when the arm 224 engages the stop, such position being shown in phantom at 230. The position 230 is only reached when the cable is disengaged from the sheave 221, for example to replace the cable; during normal operation of the take-up assembly, the sheave 221 is above the position 230.

An air cylinder 231, mounted on a plate 232 that is secured to the subframe, houses a piston (not shown) therein to which is secured a piston rod 234, on the free end of which is mounted an elastomeric bumper 235. Pressurized air may be supplied to the cylinder 231 to extend the piston rod and bumper to engage the free end of the arm 224 and drive the take-up sheave 221 to the position in phantom at 237, displacing the cable by a predetermined amount from the straight line position shown in full in FIG. 11. This is done at the start up of a press run (when the lowering of the impression rollers 22 has tightened the cable) and held for less than one minute to put sufficient slack into the cable when the piston rod is retracted so that the cable will not exert sufficient force upwardly on any impression roller to disturb the desired impression roller/design cylinder contact.

The piston rod is retracted by a biasing spring (not shown) when the pressurized air is vented from the cylinder 231. Thereafter, the take-up sheave operates freely under the influence of the cable and the weight 227.

From the cable take-up assembly 215 the web and the cable go by way of another cable driven roller 75A, identical to the roller 75, through a plurality of other press units 20, for example four additional press units to the left of the rollstand 26 as viewed in FIG. 1. Each press unit has associated therewith a cable driven roller and a cable take-up assembly. The web and cable then go back above these press units to another compensator 192A, identical to the compensator 192 just described, another cable driven roller 75B, a pair of web aligning rollers 160A and 161A, identical to the rollers 160 and 161, and through five additional press units 20, for example, to the right of the rollstand 26 as viewed in FIG. 1. Each of these press units also has a cable driven roller and a cable take-up assembly associated therewith.

From the last press unit the web and cable go by way of another pair of web aligning rollers 160B and 161B, the cable driven roller 75D and lead roller 44, which preferably includes a conventional tensiometer, and another lead roller 44A (identical to the rollers 44) to conventional folder slitters 245. As is well known to the art, the slitters include a plurality of slitter blades 246 which cooperate with a plurality of anvils 247, and when the press is running the slitters slit the web 25 into a plurality of smaller webs 25A. The web 25A go by way of a conventional draw cylinder 249 and draw trolleys 250, a roller 44B (identical to the rollers 44 and preferably including a conventional tensiometer) and a roller 252 to other elements (not shown) of a conventional folder. The draw cylinder 249 is driven through a conventional clutch (not shown) by the press drive when the press is running. During webbing the clutch is disengaged and the draw cylinder remains stationary. Mounted coaxially with the draw cylinder is a sheave (not shown) for the cable that is functionally identical to the sheave 45 shown in FIG. 3.

Figure 13:
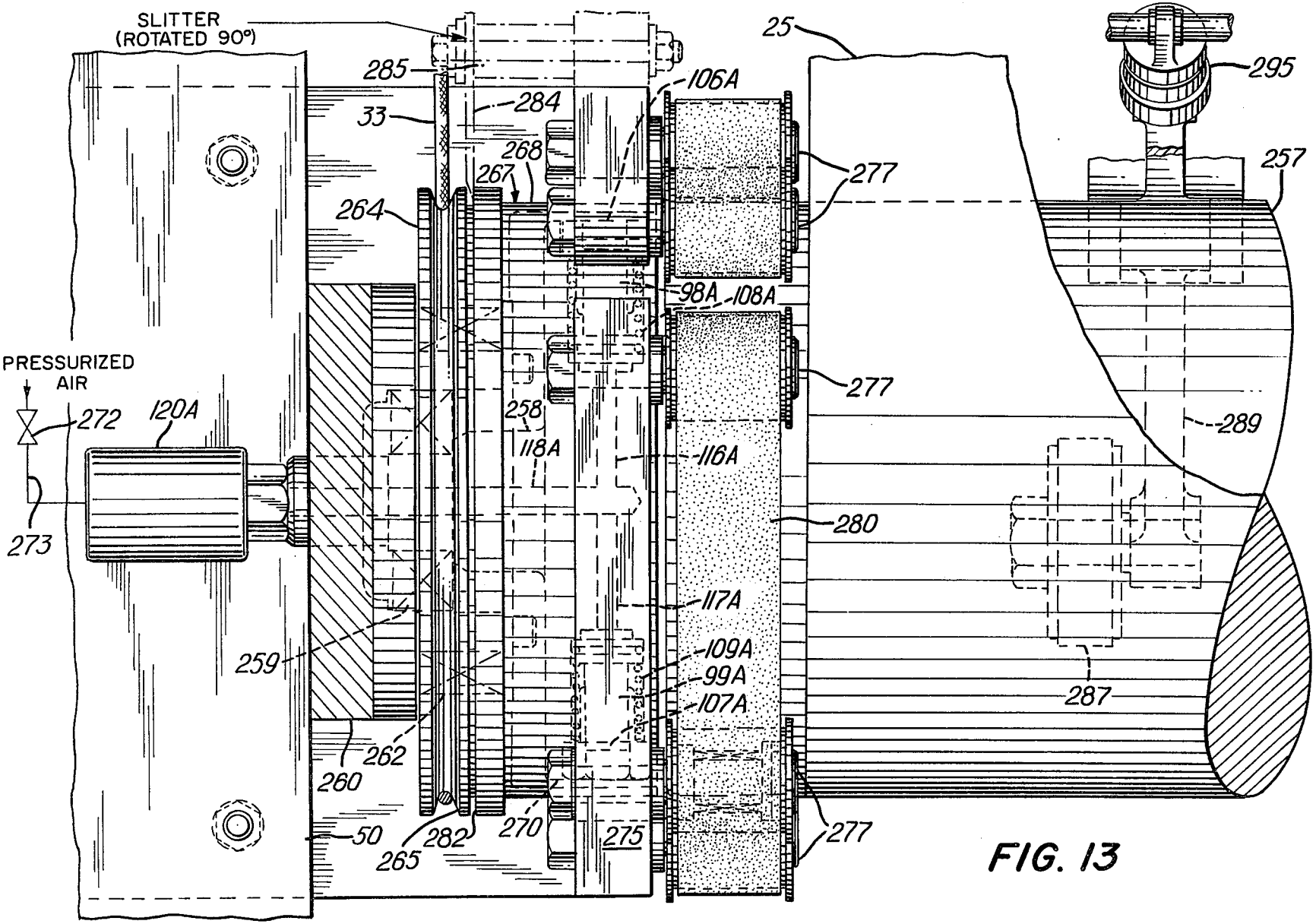
FIG. 13 is a side elevational view of a waste web rewind assembly that may be utilized in the system of the invention.
Figure 14:
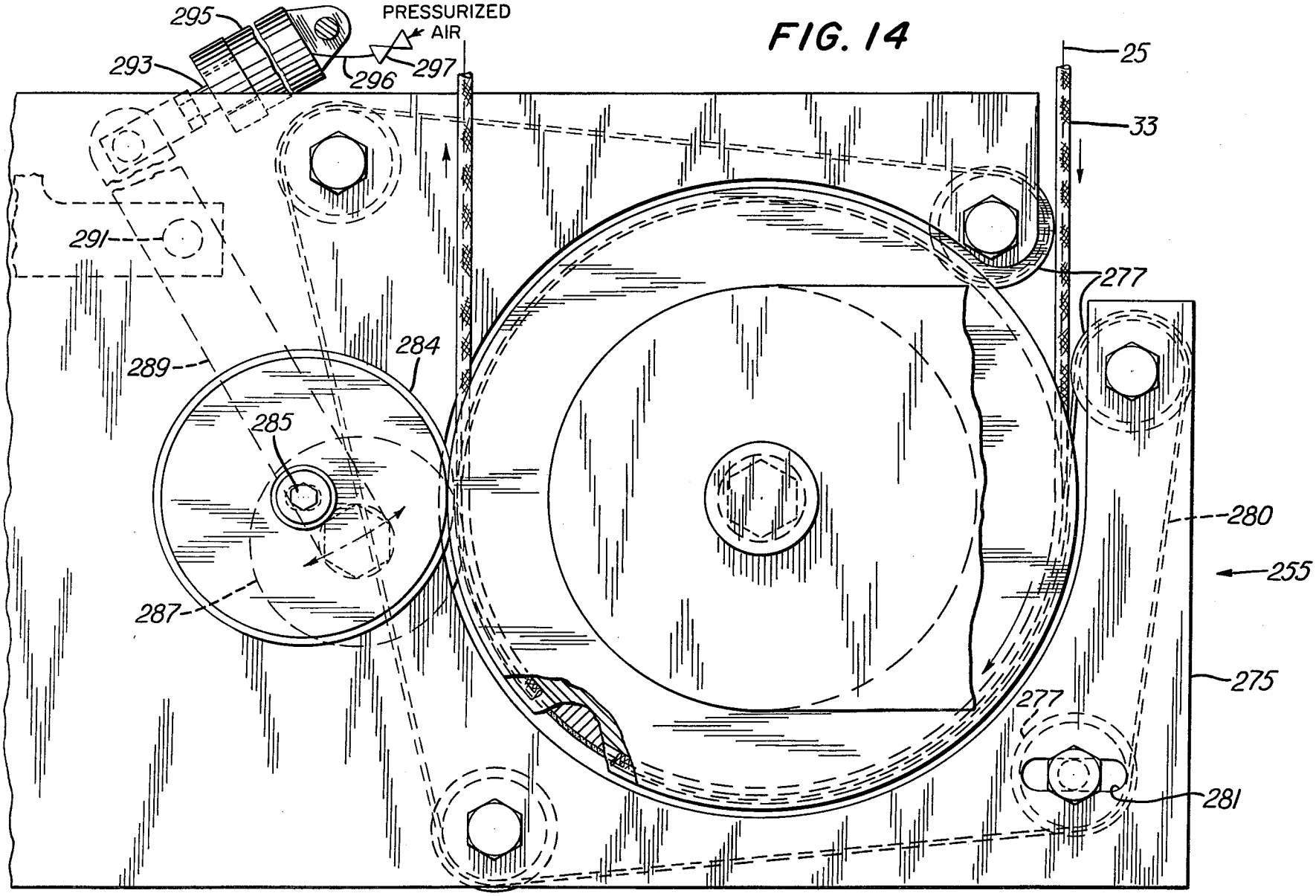
FIG. 14 is an end elevational view of the assembly illustrated in FIG. 13.

The cable 33 and any web which is being removed from the press go from the roller 44B and its associated sheave by way of a pair of additional rollers 44 and their sheaves to a waste web rewind assembly 255 (see FIGS. 13 and 14). From the rewind assembly the cable goes by way of a plurality of idler sheaves 42 to the cable drive drum 40.

The rewind assembly 255 includes a rewind roller 257, the journal 258 of which is received in a conventional non-friction bearing 259, which is mounted in a bracket 260 that is secured to the adjacent press side frame 50. The other roller journal is mounted on the opposite press side frame (not shown).

Also mounted on the bracket 260 is another non-friction bearing 262, which supports a sheave 264 so that it is coaxial with the roller 257. The sheave is formed with a groove 265 which receives the cable 33, and the diameter of the groove is such that the pitch line of the cable is coplanar with the surface of the roller 257.

Mounted on the sheave 264 and extending toward the roller 257 is a ring 267 that includes a cylindrical element 268, which extends over, in spaced relation to, a reduced diameter portion 270 of the roller. The outer surface of the ring element 268 is coplanar with the surface of the roller 257, so that the former acts as a leader guide.

Mounted for reciprocation in opposite sides of the roller reduced diameter portion 270 are a pair of pistons 98A and 99A, which have friction pads 106A and 107A, and are biased by springs 108A and 109A, respectively, to the retracted positions illustrated.

When a web is to be wound on the rewind roller 257, a valve 272 is opened to supply pressurized air through the conduit 273, rotary seal 120A, and bores 116A, 117A and 118A to the pistons 98A and 99A so as to lock the sheave 264 to the roller 257 by means of the clutch mechanism including the ring 267 and the pistons 98A, 99A with their friction pads 106A, 107A. Then the roller 257 will be driven by the cable 33 through the clutch mechanism. This clutch mechanism operates in the same manner as the clutch mechanism of FIGS. 5 and 6, and similar parts are designated by the same reference numbers, an "A" being added in FIGS. 13 and 14.

A bracket 275 mounted on the side frame 50 extends almost entirely around the roller 257 and mounts for rotation a plurality of pulleys 277 that support a tape 280 which engages the roller 257 around almost the entire circumference thereof between the web 25 and the sheave 264. A slot 281 in the bracket 275 enables the mount for one of the pulleys 277 to be displaced so as to adjust the tension of the tape 280.

A circumferential groove 282 is formed in the sheave 264 between the groove 265 and the ring 268, and a slitter wheel 284 is rotatably mounted on a post 285 that is secured to the bracket 275.

A plurality of trolley rollers 287 are mounted along the roller 257 to provide a nip to help guide and maintain tension on the web 25. Each trolley roller is mounted for rotation to one end of an arm 289, which can pivot intermediate its ends about a pin 291. The other end of the arm 289 is pinned to a piston rod 293 connected to a piston (not shown) that reciprocates in a pneumatic cylinder 295, which communicates through line 296 and valve 297 to a source of pressurized air. The piston is spring biased to lift the trolley roller 287 away from the roller 257.

When a web is to be wound on the roller 257, the valve 297 is opened to supply pressurized air to each cylinder 295 so as to urge all of the trolley rollers 287 against the roller 257. When the webbing operation has been completed, the valve 297 is closed and the cylinders 295 are vented so that the springs (not shown) in these cylinders raise the trolley rollers 287 away from the roller 257, from which the waste web may be removed.

One person can web the ten unit press illustrated with the webbing system according to the invention in approximately four to five minutes. In preparation for webbing, the impression rollers 22 are raised $\frac{3}{4}$ inch, for example, above the design cylinders 21, the cable 33 is rewound on the rewind drum 35 (if not already done), low torque is supplied from the cable rewind motor 37 to the drum 35 to maintain the desired cable tension, the valve 124 is opened to supply pressurized air to the cable driven rollers 75, 75A, etc. to lock them to their respective sheaves 77 so that these rollers will be driven by the cable, the valve 148 is opened to supply pressurized air to the cylinders 146 to drive the trolley rollers 130, 130A, etc. against the rollers 75, 75A, etc., the valve 272 is opened to supply pressurized air to the waste web rewind roller 257 to lock it to the sheave 264, and the valve 297 is opened to drive the trolley rollers 287 against the rewind roller 257.

The leading edge of the web 25 is prepared as discussed above in connection with FIG. 2, and the leader 56 and reinforcing tapes 64, 65 and 66 are attached to the web. Then the leader is connected to the cable just downstream of the first sheave 45, and the web supply roll 30 is gently rolled back to remove any slack in the web.

Next the brake (not shown) for the cable drive drum 40 is disengaged and the drive motor 39 is started forward to a relatively low "inching" speed. The cable is inched forward to make certain that the web is tracking straight and all slack has been removed. If so, the cable drive motor is accelerated to the full webbing speed.

The slitters 245 are disengaged and the draw trolleys 250 are raised away from the draw cylinder 249. The web 25 will be pulled by the cable 33 through the press units, past the slitters 245 (without being slit) and the draw cylinder 249, and by way of the rollers 44B and 44 to the rewind roller 257.

As the leader 56 comes around the rewind roller it is trapped between the tape 280 and the roller 257 and continues to the rewind slitter 284. The leader is automatically cut by the rewind slitter, freeing the leader and the web from the cable 33. The leader, being trapped by the tape 280, continues around the roller 257 and winds the web around this roller. The trolleys 287 help guide and maintain tension on the web as it builds up on the roller 257.

When the web is tracking straight at the draw cylinder 249, the cable drive motor 39 is stopped. The draw trolleys 250 are lowered to hold the web against the cylinder 249, and the web is manually severed downstream of the roller 44B.

At this time the cable 33 is rewound by closing the valves 124 and 272 and venting the pressurized air from the rollers 75 and 257 to decouple these rollers from the cable, driving the cable drive motor 39 at full speed in the reverse direction and applying high torque from the cable rewind motor 37 to the drum 35, and closing the valves 148 and 267 and venting the pressurized air from the cylinders 146 and 295 to raise the trolley rollers 130 and 287 away from the rollers 75 and 257, respectively.

After the cable has started to rewind, the folder slitters 245 can be engaged and the ribbons 25A issuing therefrom can be led through the angle bars (not shown) and other elements of the folder while inching the press, as is well known to the art.

When the cable is rewound on the rewind drum 35 a conventional limit switch on the drive drum 40 will cause the drive motor 39 to decelerate to a stop, the drive drum brake to engage and low torque to be applied from the rewind motor 37 to the drum 35 to maintain sufficient cable tension to keep the cable on the sheaves while allowing displacement of the compensators 192, 192A, etc.

The waste web can be removed from the rewind roller 257 any time after the webbing operation has been completed, but it should be removed prior to the next webbing.

If the press is to be webbed when it already has a web intact from any press unit through the folder, the slitters 245 are kept engaged and the draw trolleys 250 lowered. The web is severed upstream of the slitters, leaving enough tail for splicing.

The leading edge of the web remaining in the press is threaded the opposite way around the roller 44A, and taped to and wrapped around the rewind roller 257, so that this web portion will be removed from the press on to the rewind roller while the new web is threaded into the press.

The procedure described above is followed to bring the new web to the slitters 245, at which time the cable drive motor 39 is stopped. Then the leader 56 is disconnected from the cable upstream of the slitters and reconnected to the cable downstream of the roller 44B so as to draw the web clockwise (as viewed in FIG. 1) around the roller 44A.

The cable is started to wind the leading portion of the new web onto the rewind roller until the web is tracking straight at the roller 44A, at which time the cable is stopped. The web is severed and the leading portion thereof is spliced to the tail of the old web. The cable is rewound, the press is inched to inch the splice through the slitters to the folder, and the waste web is removed from the rewind roller.

Figure 15:
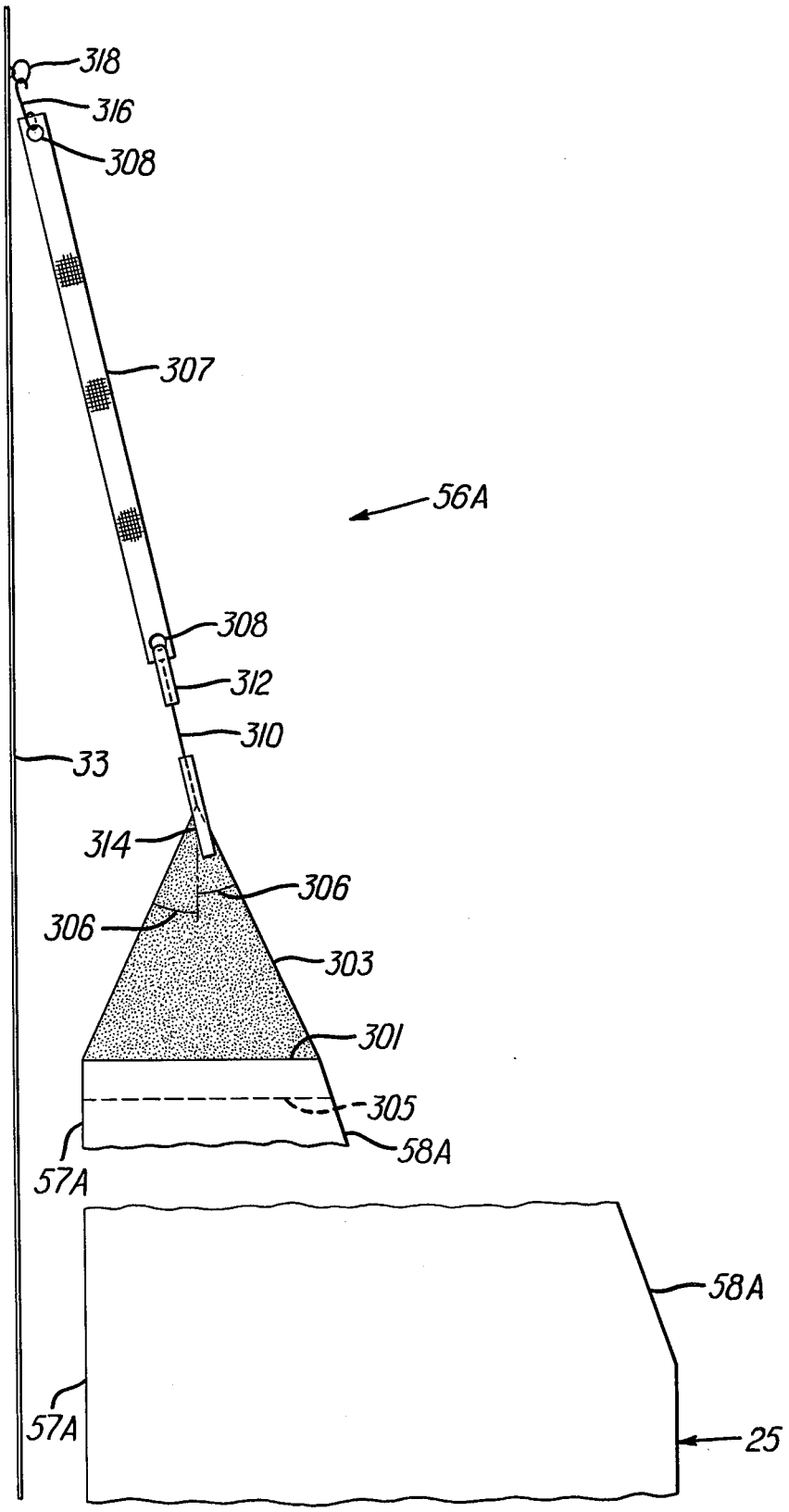
FIG. 15 is an illustration of a leader for connecting the web to the webbing cable according to another preferred embodiment of the invention.

FIG. 15 shows an alternative arrangement for connecting the web 25 to the cable 33 by a leader 56A. Here approximately $\frac{2}{3}$ of the leading edge 301 of the web is cut away to provide an angle of preferably not greater than about 25° between the lateral web edge 57A adjacent the cable and the cut edge 58A.

A plastic film 303, for example a polyester film of Mylar 0.01 inch thick, is secured to the leading edge 301 of the web by a conventional double sided sticky tape 305 that is about two inches wide, for example. Thus, one side of the tape 305 adheres to the web 25 and the other tape side adheres to the film 303. The film is generally triangular, each of the two leading edges making an angle of preferably not greater than about 25° with the lateral web edge 57A, such angles being indicated at 306.

A belting 307, which may be 5–10 feet long for a web 90 inches wide for example, includes an eyelet 308 at each end and is connected to the leading end of the film 303 with an elastomeric element 310, for example a rubber band of about $\frac{1}{8}$ inch diameter.

The band 310 is secured at one end to the adjacent eyelet 308 with a conventional plastic adhesive tape 312, the ends of which are secured to opposite sides of the band, the bight of the tape passing through the eyelet.

The other end of the band 310 is secured to the film 303 by two plastic adhesive tapes 314, which are secured to opposite sides of the band and the film. Such use of adhesive tapes in connecting the elements of the leader minimizes the thickness of the leader and thus the posibility of any interference between the leader and the press elements during webbing.

A hook 316 is secured through the eyelet 308 at the leading end of the belting 307 and is adapted to engage a ring 318 that is swivel-mounted to the cable 33. Thus, the web may be quickly connected to, or disconnected from, the cable merely by inserting the hook 316 into, or removing it from, the ring 318.

Alternatively, if the belting 307 is of elastomeric material, the band 310 and the tapes 314 may be omitted, and the belting secured to the film 303 with the tape 312, the ends of which are secured to opposite sides of the film. Both arrangements employing the belting 307 promote a trouble-free webbing of the press by resiliently connecting the web to the cable and the fact that the belting starts turning the rollers that are not driven by the cable before the web reaches them.

When webbing the press using the leader 56A and the cable including the ring 318 (FIG. 15), the procedure discussed above for the leader 56 is used with the following modifications.

After the leading edge of the web is prepared and the leader 56A secured thereto, the drive motor 39 is started forward to advance the ring 318 to a position just downstream of the first sheave 45 and the hook 316 is hooked onto the ring. Then the web is advanced at inching and webbing speeds as before until the rewind roller 257 is reached.

The rewind assembly 255 is modified for the leader 56A by removing the slitter wheel 284 (and its post 285), the tape 280 and the pulleys 277. Preferably the bracket 275 supporting these elements is also removed.

When the leader 307 reaches the rewind roller 257, the drive motor 39 is switched to the inching speed and then stopped when the leading edge 301 of the web reaches the rewind roller. The leader 56A (including the film 303) is disengaged from the ring 318 and the web, the web leading edge is taped to the rewind roller, and the drive motor is started again to wrap the web around the rewind roller. When the web is tracking straight at the draw cylinder 249, the drive motor is stopped and the remainder of the procedure for the leader 56 is followed.

If the press is to be webbed using the leader 56A when it already has a web intact from any press unit through the folder, the previously described procedure for this situation is followed, modified to follow the procedure just described for the leader 56A. When the new web has been brought to the slitters 245 and the drive motor 39 stopped, the hook 316 is disconnected from the ring 318, the drive motor is started to advance the ring to a position downstream of the roller 44B, and the hook is then reconnected to the ring, so as to draw the web clockwise around the roller 44A.

It will be understood that the above described webbing system is merely exemplary and that those skilled in the art may make many variations and modifications without departing from the spirit and scope of the invention. All such modifications and variations are intended to be within the scope of the invention as defined in the appended claims.

I claim:

1. Apparatus for threading a web from a web unwind roll through a printing press having a pair of side frames between which are mounted press elements of at least one press unit, each unit including a plurality of lead rollers for guiding the web through the unit and between a first cylinder adapted to apply ink to the web and a second cylinder, comprising a cable disposed between the side frames and extending substantially parallel to and coplanar with the path of the web through the printing press, a plurality of sheaves for supporting the cable, each sheave mounted adjacent to and coaxially with a different one of the lead rollers, the diameter of each sheave being such that the centerline of the portion of the cable engaged by the sheave is substantially coplanar with the surface of the corresponding lead roller, means for connecting the leading edge of the web to the cable, and means for driving the cable in the direction to feed the web through the printing press, and wherein the connecting means includes a leader attached to the leading edge of the web and to the cable, the cable includes means forming a ring and the leader includes a hook adapted to engage the ring means, and the leader includes a belting to one end of which the hook is secured and a plastic film of generally triangular shape, the leading corner of the film being connected to the other end of the belting and the opposite side of the film being attached to the leading edge of the web.

2. The apparatus according to claim 1 wherein the belting is elastomeric.

3. The apparatus according to claim 1 wherein the leader includes elastomeric means for resiliently connecting the web to the cable.

4. Apparatus for threading a web from a web unwind roll through a printing press having a pair of side frames between which are mounted press elements of at least one press unit, each unit including a plurality of lead rollers for guiding the web through the unit and between a first cylinder adapted to apply ink to the web and a second cylinder, comprising a cable disposed between the side frames and extending substantially parallel to and coplanar with the path of the web through the printing press, a plurality of sheaves for supporting the cable, each sheave mounted adjacent to and coaxially with a different one of the lead rollers, the diameter of each sheave being such that the centerline of the portion of the cable engaged by the sheave is substantially coplanar with the surface of the corresponding lead roller, means for connecting the leading edge of the web to the cable, means for driving the cable in the direction to feed the web through the printing press, wherein at least one lead roller in each unit is mounted for rotation independently of the corresponding sheave and including clutch means for releasably connecting that lead roller and its sheave for rotation together, means for activating the clutch means so that the cable rotates that lead roller when the cable is pulled to feed the web through the printing press, wherein the clutch means includes at least one piston mounted in the end of the lead roller adjacent the sheave for reciprocation between an extended position in which the lead roller and the sheave are connected and a retracted position in which the lead roller and the sheave are disconnected, and means for biasing each piston toward its retracted position.

5. The apparatus according to claim 4 wherein the activating means includes means for applying fluid under pressure to each piston to drive it to the extended position.

6. Apparatus for threading a web from a web unwind roll through a printing press having a pair of side frames between which are mounted press elements of at least one press unit, each unit including a plurality of lead rollers for guiding the web through the unit and between a first cylinder adapted to apply ink to the web and a second cylinder, comprising a cable disposed between the side frames and extending substantially parallel to and coplanar with the path of the web through the printing press, a plurality of sheaves for supporting the cable, each sheave mounted adjacent to and coaxially with a different one of the lead rollers, the diameter of each sheave being such that the centerline of the portion of the cable engaged by the sheave is substantially coplanar with the surface of the corresponding lead roller, means for connecting the leading edge of the web to the cable, means for driving the cable in the direction to feed the web through the printing press, a waste web roller for winding the leading portion of the web after the web has been threaded through the printing press, a sheave for supporting the cable mounted adjacent to and coaxially with the waste web roller, means adpated to cooperate with the waste web roller for winding the leading portion of the web on the waste web roller, and means for cutting the connecting means after the cooperating means and the waste web roller have begun to wind the web on the waste web roller.

7. The apparatus according to claim 6 wherein the waste web roller is mounted for rotation independently of its sheave and including clutch means for releasably connecting the waste web roller and its sheave for rotation together, and means for activating the clutch means so that the cable rotates the waste web roller when the web is being wound thereon.

8. The apparatus according to claim 6 wherein the cooperating means includes a tape mounted to engage a portion of the circumference of the waste web roller and move therewith so as to engage the connecting means when the connecting means is fed therebetween, and the cutting means cuts the connecting means at a location between the sheave and the tape.

9. The apparatus according to claim 8 wherein the connecting means includes a leader attached to the leading edge of the web and to the cable, and the cutting means includes a rotary knife blade.

* * * * *